US012453373B2

(12) United States Patent
Lavanchy et al.

(10) Patent No.: US 12,453,373 B2
(45) Date of Patent: Oct. 28, 2025

(54) AEROSOL-GENERATING DEVICE WITH SEALING ELEMENTS IN CAVITY

(71) Applicant: PHILIP MORRIS PRODUCTS S.A., Neuchatel (CH)

(72) Inventors: Frederic Lavanchy, Chavornay (CH); Johannes Petrus Maria Pijnenburg, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 545 days.

(21) Appl. No.: 17/638,907

(22) PCT Filed: Sep. 4, 2020

(86) PCT No.: PCT/EP2020/074844
§ 371 (c)(1),
(2) Date: Feb. 28, 2022

(87) PCT Pub. No.: WO2021/044020
PCT Pub. Date: Mar. 11, 2021

(65) Prior Publication Data

US 2022/0295878 A1 Sep. 22, 2022

(30) Foreign Application Priority Data

Sep. 6, 2019 (EP) ..... 19195957

(51) Int. Cl.
*A24F 47/00* (2020.01)
*A24D 1/02* (2006.01)
(Continued)

(52) U.S. Cl.
CPC ..... *A24F 40/40* (2020.01); *A24D 1/02* (2013.01); *A24D 1/20* (2020.01); *A24F 40/20* (2020.01)

(58) Field of Classification Search
CPC ..... A24F 40/00; A24F 40/20; A24F 40/40; A24F 40/465
See application file for complete search history.

(56) References Cited

U.S. PATENT DOCUMENTS 4,998,541 A 3/1991 Perfetti
5,591,368 A 1/1997 Fleischhauer
(Continued)

FOREIGN PATENT DOCUMENTS

EP 2578093 4/2013
JP H11-503912 4/1999
(Continued)

OTHER PUBLICATIONS

PCT International Search Report and Written Opinion for PCT/EP2020/074844 dated Jan. 27, 2021 (19 pages).
(Continued)

*Primary Examiner* — Eric Yaary
(74) *Attorney, Agent, or Firm* — Mueting Raasch Group

(57) ABSTRACT

The invention relates to an aerosol-generating device comprising a cavity. The cavity is configured to receive an aerosol-generating article. The device comprises a first sealing element arranged along a sidewall of the cavity. The first sealing element is arranged at an upstream portion of the cavity. The device comprises a second sealing element. The second sealing element is arranged at a downstream portion of the sidewall of the cavity. The device further comprises a power supply and a heating element. The heating element is an external heating element.

11 Claims, 5 Drawing Sheets

(51) Int. Cl.

| | |
|---|---|
| ***A24D 1/20*** | (2020.01) |
| ***A24F 40/20*** | (2020.01) |
| ***A24F 40/40*** | (2020.01) |

(56) References Cited

U.S. PATENT DOCUMENTS

| | | | | |
|---|---|---|---|---|
| 6,053,176 | A * | 4/2000 | Adams | A24F 40/53 131/329 |
| 9,980,521 | B2 | 5/2018 | Buehler | |
| 10,617,149 | B2 | 4/2020 | Malgat | |
| 2016/0331031 | A1* | 11/2016 | Malgat | A24D 1/20 |
| 2016/0331032 | A1* | 11/2016 | Malgat | A24B 3/14 |
| 2017/0238603 | A1 | 8/2017 | Papakyrillou | |
| 2018/0235285 | A1 | 8/2018 | Robinson | |
| 2021/0112878 | A1* | 4/2021 | Ruscio | A24F 40/46 |

FOREIGN PATENT DOCUMENTS

| | | |
|---|---|---|
| JP | 2017525338 | 9/2017 |
| KR | 1020160094938 | 8/2016 |
| KR | 1020170026352 | 3/2017 |
| KR | 1020170063570 | 6/2017 |
| WO | WO 96/32854 | 10/1996 |
| WO | WO 2013/120854 | 8/2013 |
| WO | WO 2015/082649 | 6/2015 |
| WO | WO 2016/050883 | 4/2016 |
| WO | WO 2016/156223 | 10/2016 |
| WO | WO 2017/101058 | 6/2017 |

OTHER PUBLICATIONS

Office Action issued in Japan for Application No. 2020-513898 dated Mar. 30, 2023 (4 pages). English translation included.

Notice of Allowance for Korean Application No. 10-2022-7007200 dated Jul. 31, 2024 (4 pages). English translation included.

* cited by examiner

AEROSOL-GENERATING DEVICE WITH SEALING ELEMENTS IN CAVITY

This application is a U.S. National Stage Application of International Application No. PCT/EP2020/074844 filed Sep. 4, 2020, which was published in English on Mar. 11, 2021, as International Publication No. WO 2021/044020 A1. International Application No. PCT/EP2020/074844 claims priority to European Application No. 19195957.6 dated Sep. 6, 2019.

The present invention relates to an aerosol-generating device, an aerosol-generating article and an aerosol-generating system.

It is known to provide an aerosol-generating device for generating an inhalable vapor. Such devices may heat aerosol-forming substrate to a temperature at which one or more components of the aerosol-forming substrate are volatilised without burning the aerosol-forming substrate. Aerosol-forming substrate may be provided as part of an aerosol-generating article. The aerosol-generating article may have a rod shape for insertion of the aerosol-generating article into a cavity, such as a heating chamber, of the aerosol-generating device. A heating element may be arranged in or around the heating chamber for heating the aerosol-forming substrate once the aerosol-generating article is inserted into the heating chamber of the aerosol-generating device.

Ambient air is generally drawn into the heating chamber and through the aerosol-generating article. During use, the entirety of incoming air may not all be drawn through the aerosol-generating article. This may occur, for example, due to a gap between the aerosol-generating article and the sidewall of the heating chamber. Such a gap may result in some air escaping the heating chamber without passing through the aerosol-generating article and becoming entrained with volatilised aerosol-forming substrate. This may result in reduced aerosol delivery to the user. Such a gap may result in generated aerosol escaping from the heating chamber without passing through a mouthpiece element of the aerosol-generating device or of the aerosol-generating article for delivery to a user. This may result in reduced aerosol delivery to the user. The gap may be a result of manufacturing tolerances. The gap may be a result of thermal deformation of parts of the aerosol-generating device or of the aerosol-generating article during use. The gap may negatively influence the heating efficiency due to a part of the airflow being lost through the gap between the aerosol-generating article and the heating chamber.

It would be desirable to provide an aerosol-generating device with improved heating efficiency. It would be desirable to provide an aerosol-generating device having improved airflow. It would be desirable to provide an aerosol-generating device, in which ambient air is drawn completely through a received aerosol-generating article.

According to an embodiment of the invention there is provided an aerosol-generating device that may comprise a cavity. The cavity may be configured to receive an aerosol-generating article. The device may further comprise a first sealing element arranged along a sidewall of the cavity. The first sealing element may be arranged at an upstream portion of the cavity. The device may further comprise a second sealing element. The second sealing element may be arranged at a downstream portion of the sidewall of the cavity. In some embodiments, the first sealing element may be arranged to provide a circumferential seal between the sidewall of the cavity and an aerosol-generating article when the aerosol-generating article is received in the cavity. In some embodiments, the second sealing element may be arranged to provide a circumferential seal between the sidewall of the cavity and an aerosol-generating article when the aerosol-generating article is received in the cavity.

According to an embodiment of the invention there is provided an aerosol-generating device comprising a cavity. The cavity is configured to receive an aerosol-generating article. The device further comprises a first sealing element arranged along a sidewall of the cavity. The first sealing element is arranged at an upstream portion of the cavity. The device further comprises a second sealing element. The second sealing element is arranged at a downstream portion of the sidewall of the cavity.

By providing two sealing elements at a downstream portion and an upstream portion of the cavity, respectively, airflow is forced through the aerosol-generating article. By providing the two sealing elements according to the present invention at the downstream portion of the cavity and at the upstream portion of the cavity, airflow is substantially prevented or completely prevented between the sidewall of the cavity and the aerosol-generating article between the two sealing elements. By providing two sealing elements according to the present invention, this helps to prevent air flowing out of the aerosol-generating article downstream of the single sealing element. If air were to flow out of the aerosol-generating article downstream of the single sealing element, such air may be heated as it passes along the heating chamber, which may lead to hot air being delivered to a user in addition to generated aerosol. Such hot air may be unpleasant for a user. Hot air between the sidewall of the cavity and the aerosol-generating article may further be undesired due to potential contamination of the hot air, for example by by-products/de-gasing from a heating element, heating element connections, wires or wires insulation material. The present invention helps to overcome these problems.

The distance between the two sealing elements is preferably essentially the entire length of a substrate portion of the aerosol-generating article received in the cavity. The present invention provides an aerosol-generating device wherein airflow is prevented from exiting the cavity other than through the aerosol-generating article.

The cavity may be a heating chamber. The cavity may have a cylindrical shape. The cavity may have a hollow cylindrical shape. The cavity may have a circular cross-section. If desirable, the cavity may have a shape deviating from a cylindrical shape or a cross-section deviating from a circular cross-section. The cavity may have a shape corresponding to the shape of the aerosol-generating article to be received in the cavity. The cavity may have an elliptical or rectangular cross-section. The cavity may have a base at an upstream end of the cavity. The base may be circular. One or more air inlets may be arranged at or adjacent the base. An airflow channel may run through the cavity. Ambient air may be drawn into the aerosol-generating device, into the cavity and towards the user through the airflow channel. Downstream of the cavity, a mouthpiece may be arranged or a user may directly draw on the aerosol-generating article. The airflow channel may extend through the mouthpiece.

The sidewall of the cavity may surround the cavity. The sidewall may connect the base of the cavity at the upstream end of the cavity and the downstream end of the cavity. The downstream end of the cavity may be open. The open downstream end may be configured for insertion of the aerosol-generating article. The upstream end of the cavity may abut the upstream end of the sidewall. The downstream end of the cavity may abut the downstream end of the sidewall.

The first sealing element may be arranged at the upstream portion of the sidewall of the cavity. The first sealing element may prevent airflow in the region of the first sealing element. The upstream portion is a portion or area adjacent the upstream end of the cavity. The upstream portion may be a portion of the sidewall adjacent or in the vicinity of the base of the cavity. The upstream portion of the sidewall may extend less than 50% of the length of the sidewall from the upstream end of the cavity, preferably less than 40% of the length of the sidewall from the upstream end of the cavity, preferably less than 30% of the length of the sidewall from the upstream end of the cavity, preferably less than 20% of the length of the sidewall from the upstream end of the cavity and more preferably less than 10% of the length of the sidewall from the upstream end of the cavity.

The second sealing element may be arranged at the downstream portion of the sidewall of the cavity. The second sealing element may prevent airflow in the region of the second sealing element. The downstream portion is a portion or area adjacent the downstream end of the cavity. The downstream portion may be a portion of the sidewall adjacent or in the vicinity of the open end of the cavity. The downstream portion of the sidewall may extend less than 50% of the length of the sidewall from the downstream end of the cavity, preferably less than 40% of the length of the sidewall from the downstream end of the cavity, preferably less than 30% of the length of the sidewall from the downstream end of the cavity, preferably less than 20% of the length of the sidewall from the downstream end of the cavity and more preferably less than 10% of the length of the sidewall from the downstream end of the cavity.

One or both of the first and second sealing elements may be ring-shaped. One or both of the first and second sealing elements may have a circular cross-section. One or both of the first and second sealing elements may have a rectangular cross-section. One or both of the first and second sealing elements may fully encircle the cavity. Each of the first and second sealing elements may each be arranged to provide a circumferential seal between the sidewall of the cavity and an aerosol-generating article when the aerosol-generating article is received in the cavity. One or both of the first and second sealing elements may be arranged in a plane perpendicular to the longitudinal axis of the cavity. One or both of the first and second sealing elements may be arranged in a plane perpendicular to the longitudinal axis of the aerosol-generating device. One or both of the first and second sealing elements may be configured as O-rings. One or both of the first and second sealing elements may comprise thermo-resistant material. One or both of the first and second sealing elements may consist of thermo-resistant material. One or both of the first and second sealing elements may have an inner diameter corresponding to or slightly smaller than the outer diameter of the aerosol-generating article. One or both of the first and second sealing elements may have an outer diameter corresponding to or slightly larger than the inner diameter of the sidewall of the cavity.

One or both of the first and second sealing elements may be stationary. One or both of the first and second sealing elements may be arranged in a groove of the sidewall of the cavity. The groove may be configured to engage with one or both of the first and second sealing elements. The first sealing element may be arranged in a first groove of the sidewall. The first sealing element may be mounted in the first groove of the sidewall. The second sealing element may be arranged in a second groove of the sidewall. The second sealing element may be mounted in the second groove of the sidewall. The first groove may be arranged at the upstream portion of the sidewall of the cavity. The second groove may be arranged at the downstream portion of the sidewall of the cavity.

In some embodiments, the aerosol-generating device comprises a power supply and a heating element. In some embodiments, the heating element comprises an external heating element. In some embodiments, the heating element comprises an internal heating element. In some embodiments, the heating element comprises both an internal heating element and an external heating element.

The power supply may be a battery. The power supply may be arranged in a main body of the aerosol-generating device. In some embodiments, the power supply is a Lithium-ion battery. In some embodiments, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery. As an alternative, the power supply may be another form of charge storage device such as a capacitor. The power supply may require recharging and may have a capacity that enables to store enough energy for one or more usage experiences; for example, the power supply may have sufficient capacity to continuously generate aerosol for a period of around six minutes or for a period of a multiple of six minutes. In another example, the power supply may have sufficient capacity to provide a predetermined number of puffs or discrete activations of the aerosol-generating device.

The heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum platinum, gold and silver. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese-, gold- and iron-containing alloys, and superalloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required.

The heating element may be part of an aerosol-generating device. The aerosol-generating device may comprise an internal heating element or an external heating element, or both internal and external heating elements, where "internal" and "external" refer to the aerosol-forming substrate. An internal heating element may take any suitable form. For example, an internal heating element may take the form of a heating blade. Alternatively, the internal heater may take the form of a casing or substrate having different electro-conductive portions, or an electrically resistive metallic tube. Alternatively, the internal heating element may be one or more heating needles or rods that run through the center of the aerosol-forming substrate. Other alternatives include a heating wire or filament, for example a Ni—Cr (Nickel-Chromium), platinum, tungsten or alloy wire or a heating plate. Optionally, the internal heating element may be deposited in or on a rigid carrier material. In one such embodiment, the electrically resistive heating element may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heating elements during operation. The internal heating element may be arranged in the cavity, preferably in the sense of the cavity. The internal heating element may be mounted at the base of the cavity.

An external heating element may take any suitable form. For example, an external heating element may take the form of one or more flexible heating foils on a dielectric substrate, such as polyimide. The flexible heating foils can be shaped to conform to the perimeter of the substrate receiving cavity. Alternatively, an external heating element may take the form of a metallic grid or grids, a flexible printed circuit board, a molded interconnect device (MID), ceramic heater, flexible carbon fibre heater or may be formed using a coating technique, such as plasma vapour deposition, on a suitable shaped substrate. An external heating element may also be formed using a metal having a defined relationship between temperature and resistivity. In such an exemplary device, the metal may be formed as a track between two layers of suitable insulating materials. An external heating element formed in this manner may be used to both heat and monitor the temperature of the external heating element during operation.

The internal or external heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The heating element advantageously heats the aerosol-forming substrate by means of conduction. The heating element may be at least partially in contact with the substrate, or the carrier on which the substrate is deposited. Alternatively, the heat from either an internal or external heating element may be conducted to the substrate by means of a heat conductive element.

During operation, the aerosol-forming article may be completely contained within the cavity of the aerosol-generating device. In that case, a user may puff on a mouthpiece of the aerosol-generating device. Alternatively, during operation the aerosol-generating article may be partially received in the cavity of the aerosol-generating device. In that case, the user may draw directly on the aerosol-generating article.

In some embodiments, for example instead of, or in addition to an electrically resistive heating element, the heating element may be configured as an induction heating element. The induction heating element may comprise an induction coil and a susceptor. In general, the susceptor is a material that is capable of absorbing electromagnetic energy and converting it to heat. When located in an alternating electromagnetic field, typically eddy currents are induced and hysteresis losses occur in the susceptor causing heating of the susceptor. Changing electromagnetic fields generated by one or several induction coils heat the susceptor, which then transfers the heat to the aerosol-generating article, such that an aerosol is formed. The heat transfer may be mainly by conduction of heat. Such a transfer of heat is best, if the susceptor is in close thermal contact with the aerosol-generating article.

The susceptor may comprise from any material that can be inductively heated to a temperature sufficient to generate an aerosol from the aerosol-forming substrate. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius.

Preferred susceptors are metal susceptors, for example stainless steel. However, susceptor materials may also comprise or be made of graphite, molybdenum, silicon carbide, aluminum, niobium, Inconel alloys (austenite nickel-chromium-based superalloys), metallized films, ceramics such as for example zirconia, transition metals such as for example iron, cobalt, nickel, or metalloids components such as for example boron, carbon, silicon, phosphorus, aluminium.

Preferably, the susceptor material is a metallic susceptor material. The susceptor may also be a multi-material susceptor and may comprise a first susceptor material and a second susceptor material. In some embodiments, the first susceptor material may be disposed in intimate physical contact with the second susceptor material. The second susceptor material preferably has a Curie temperature that is below the ignition point of the aerosol-forming substrate. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Suitable materials for the second susceptor material may include nickel and certain nickel alloys.

By providing a susceptor having at least a first and a second susceptor material, the heating of the aerosol-forming substrate and the temperature control of the heating may be separated. Preferably the second susceptor material is a magnetic material having a second Curie temperature that is substantially the same as a desired maximum heating temperature. That is, it is preferable that the second Curie temperature is approximately the same as the temperature that the susceptor should be heated to in order to generate an aerosol from the aerosol-forming substrate.

When an induction heating element is employed, the induction heating element may be configured as an internal heating element as described herein or as an external heater as described herein. If the induction heating element is configured as an internal heating element, the susceptor element is preferably configured as a pin or blade for penetrating the aerosol-generating article. If the induction heating element is configured as an external heating element, the susceptor element is preferably configured as a cylindrical susceptor at least partly surrounding the cavity or forming the sidewall of the cavity.

The device may comprise a recess in the sidewall of the cavity adjacent the base of the cavity. The recess may fully surround the sidewall. The recess may be configured to receive residues of aerosol-forming substrate or debris. Particularly, residues of aerosol-forming substrate may stick to the sidewall of the cavity after an aerosol-generating article is depleted and removed from the cavity. When a fresh aerosol-generating article is inserted into the cavity, the fresh aerosol-generating article may scrape off residues from the sidewall of the cavity and push the residues in the direction of the base of the cavity. The residues of the aerosol-forming substrate may accumulate at the base of the cavity, which may be undesired. By providing the recess, these residues may be pushed into the recess during insertion of a fresh aerosol-generating article into the cavity. The recess may be ring-shaped. The recess may have a rectangular cross-section. The recess may have a curved cross-section. The recess may be arranged upstream of the first sealing element.

The device may comprise a bottom element arranged adjacent the base of the cavity. The bottom element may be configured to close the cavity at the base of the cavity. The bottom element may form the base of the cavity. The bottom element may be movable.

The bottom element may be movable relative to the base of the cavity. The bottom element may be movable from a first position to a second position, wherein, in the first position, the bottom element closes the cavity and in the second position, the cavity is open. The bottom element may be configured pivotably or slidably attached to the base of the cavity. This may enable opening of the cavity at the base of the cavity. Opening of the cavity may be facilitated by a pivotal or sliding movement of the bottom element away from the base of the cavity. Closing of the cavity may be facilitated by a pivotal or sliding movement of the bottom element towards the base of the cavity. If a recess is provided in the sidewall adjacent the base of the cavity as described herein, opening of the cavity may enable cleaning of the recess. The upstream end face of the recess may be formed by the bottom element. In some embodiments, a recess may be provided in the bottom element. The recess in the bottom element may help to trap or at least catch residues or debris.

Potentially, in some embodiments, the first and second sealing elements are deemed not necessary, for example if the manufacturing tolerances between the aerosol-generating article and the cavity are small enough such that airflow between the sidewall of the cavity and the aerosol-generating article is substantially prevented. In such a case, the bottom element may still be provided to enable access to the cavity at the upstream end of the cavity. In other words, as an alternative or additionally to the aerosol-generating device comprising the first and second sealing elements as described herein, an aerosol-generating device comprising the bottom element as described herein may be provided.

The aerosol-generating device may comprise electric circuitry. The electric circuitry may comprise a microprocessor, which may be a programmable microprocessor. The microprocessor may be part of a controller. The electric circuitry may comprise further electronic components. The electric circuitry may be configured to regulate a supply of power to the heating element. Power may be supplied to the heating element continuously following activation of the aerosol-generating device or may be supplied intermittently, such as on a puff-by-puff basis. The power may be supplied to the heating element in the form of pulses of electrical current. The electric circuitry may be configured to monitor the electrical resistance of the heating element, and preferably to control the supply of power to the heating element dependent on the electrical resistance of the heating element.

In some embodiments, operation of the heating element may be triggered by a puff detection system. In some embodiments, the heating element may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through an airflow path of the aerosol-generating device per time by the user. The initiation of the puff may be detected by the airflow sensor when the airflow exceeds a predetermined threshold. Initiation may also be detected upon a user activating a button.

The sensor may be configured as a pressure sensor to measure the pressure of the air inside the aerosol-generating device which is drawn through the airflow path of the device by the user during a puff. The sensor may be configured to measure a pressure difference or pressure drop between the pressure of ambient air outside of the aerosol-generating device and of the air which is drawn through the device by the user. The pressure of the air may be detected at the air inlet, the mouthpiece of the device, the heating chamber or any other passage or chamber within the aerosol-generating device, through which the air flows. When the user draws on the aerosol-generating device, a negative pressure or vacuum is generated inside the device, wherein the negative pressure may be detected by the pressure sensor. The term "negative pressure" is to be understood as a pressure which is relatively lower than the pressure of ambient air. In other words, when the user draws on the device, the air which is drawn through the device has a pressure which is lower than the pressure off ambient air outside of the device. The initiation of the puff may be detected by the pressure sensor if the pressure difference exceeds a predetermined threshold.

As used herein, the terms 'upstream' and 'downstream' are used to describe the relative positions of components, or portions of components, of the aerosol-generating device in relation to the direction in which a user draws on the aerosol-generating device during use thereof. The term 'downstream' may refer to a position relatively closer to a mouth end. The term 'upstream' may refer to a position relatively further from the mouth end, preferably closer to an opposed end.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder. The device may be an electrically heated smoking device. The aerosol-generating device may comprise a housing, electric circuitry, a power supply, a heating chamber and a heating element.

The invention further relates to an aerosol-generating article comprising:

a wrapping paper around the outer circumference of the aerosol-generating article; and a first sealing wrapper, wherein the first sealing wrapper partly covers the wrapping paper and increases the diameter of the aerosol-generating article in the region of the first sealing wrapper.

The aerosol-generating article may comprise a substrate portion. The substrate portion may comprise the aerosol-forming substrate. The substrate portion may be arranged adjacent to an upstream end of the aerosol-generating article. The aerosol-generating article may further comprise a filter portion. The filter portion may be arranged adjacent to a downstream end of the aerosol-generating article. The wrapping paper may be configured at least partially surrounding the substrate portion and partly surrounding the filter portion such as to connect and hold together the two portions of the aerosol-generating article.

The first sealing wrapper may be ring-shaped. The first sealing wrapper may circumferentially or perimetrically surround the aerosol-generating article. The first sealing wrapper may circumferentially or perimetrically surround the wrapping paper. The first sealing wrapper may fully surround the outer circumference or perimeter of the aerosol-generating article. The first sealing wrapper may have a circular or rectangular cross-section. The first sealing wrapper may be made of a cigarette paper. The first sealing wrapper may have a high friction outer surface. The outer surface of the first sealing wrapper may comprise a high friction coating. The first sealing wrapper may be air impermeable. The first sealing wrapper may be configured as a coating.

The article may comprise a second sealing wrapper, wherein the first sealing wrapper may be arranged at an upstream portion of the aerosol-generating article and the second sealing wrapper may be arranged at a downstream portion of the aerosol-generating article.

The second sealing wrapper may be ring-shaped. The second sealing wrapper may circumferentially or perimetrically surround the aerosol-generating article. The second sealing wrapper may circumferentially or perimetrically surround the wrapping paper. The second sealing wrapper may fully surround the outer circumference or perimeter of the aerosol-generating article. The second sealing wrapper may have a circular or rectangular cross-section. The second sealing wrapper may be made of a cigarette paper. The second sealing wrapper may have a high friction outer surface. The outer surface of the second sealing wrapper may comprise a high friction coating. The second sealing wrapper may be air impermeable. The second sealing wrapper may be configured as a coating.

The wrapping paper may be configured air impermeable.

As used herein, the term 'aerosol-generating article' refers to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable.

The aerosol-generating article may be substantially cylindrical in shape. The aerosol-generating article may be substantially elongate. The aerosol-generating article may have a length and a circumference substantially perpendicular to the length. The aerosol-generating article may be substantially rod shaped. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be substantially rod shaped.

The aerosol-generating article may have a total length between approximately 30 mm and approximately 100 mm. The aerosol-generating article may have an external diameter between approximately 5 mm and approximately 12 mm. The aerosol-generating article may comprise a filter plug in the filter portion. The filter plug may be located at a downstream end of the aerosol-generating article. The filter plug may be a cellulose acetate filter plug. The filter plug may have a length of between approximately 5 mm to approximately 15 mm. In some embodiments, the filter plug is approximately 7 mm in length.

In some embodiments, the aerosol-generating article has a total length of approximately 45 mm. The aerosol-generating article may have an external diameter of approximately 5.3 mm. The smaller the diameter of the substrate is, the lower is the temperature that is required to raise the core temperature of the aerosol-generating article such that sufficient amounts of material is release to form a desired amount of aerosol. At the same time, a small diameter allows for a fast penetration of the heat into the entire volume of aerosol-forming substrate. Nevertheless, where the diameter is too small, the volume to surface ratio of the aerosol-forming substrate becomes unattractive as the amount of available aerosol-forming substrate diminishes. A preferred range of diameter between 5 and 6 millimeters is particularly advantageous in terms of a balance between energy consumption and aerosol delivery. Further, the aerosol-forming substrate may have a length of approximately 10 mm. Alternatively, the aerosol-forming substrate may have a length of approximately 12 mm. Alternatively, the aerosol-forming substrate may have a length of between 10 mm and 32 mm, preferably around 22 mm. Further, the diameter of the aerosol-forming substrate may be between approximately 5 mm and approximately 12 mm. The aerosol-generating article may comprise an outer paper wrapper as the wrapping paper. Further, the aerosol-generating article may comprise a separation between the aerosol-forming substrate and the filter plug. The separation may be approximately 18 mm, but may be in the range of approximately 5 mm to approximately 25 mm.

Preferably, the aerosol-forming substrate comprises cut-filler. In this document, "cut-filler" is used to refer to a blend of shredded plant material, in particular leaf lamina, processed stems and ribs, homogenized plant material, like for example made into sheet form using casting or papermaking processes. The cut filler may also comprise other after-cut, filler tobacco or casing. According to preferred embodiments of the invention, the cut-filler comprises at least 25 percent of plant leaf lamina, more preferably, at least 50 percent of plant leaf lamina, still more preferably at least 75 percent of plant leaf lamina and most preferably at least 90 percent of plant leaf lamina. Preferably, the plant material is one of tobacco, mint, tea and cloves, however, the invention is equally applicable to other plant material that has the ability to release substances upon the application of heat that can subsequently form an aerosol.

Preferably, the tobacco plant material comprises lamina of one or more of bright tobacco lamina, dark tobacco, aromatic tobacco and filler tobacco. Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts. Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. Typically, these dark tobaccos are air cured and possibly fermented. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf. Aromatic tobaccos are tobaccos that often have small, light coloured leaves. Throughout the specification, the term "aromatic tobacco" is used for other tobaccos that have a high aromatic content, e.g. of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cure Brazil lower stalk.

The cut-filler suitable to be used with the present invention generally may resemble to cut-filler used for conventional smoking articles. The cut width of the cut filler preferably is between 0.3 millimeters and 2.0 millimeters, more preferably, the cut width of the cut filler is between 0.5 millimeters and 1.2 millimeters and most preferably, the cut width of the cut filler is between 0.6 millimeters and 0.9 millimeters. The cut width may play a role in the distribution of heat inside the substrate portion of the article. Also, the cut width may play a role in the resistance to draw of the article. Further, the cut width may impact the overall density of the substrate portion.

The strand length of the cut-filler is to some extent a random value as the length of the strands will depend on the overall size of the object that the strand is cut off from. Nevertheless, by conditioning the material before cutting, for example by controlling the moisture content and the overall subtlety of the material, longer strands can be cut. Preferably, the strands have a length of between about 10 millimeters and about 40 millimeters before the strands are formed into the substrate section. Obviously, if the strands are arranged in a substrate section in a longitudinal extension where the longitudinal extension of the section is below 40 millimeters, the final substrate section may comprise strands that are on average shorter than the initial strand length. Preferably, the strand length of the cut-filler is such that between about 20 percent and 60 percent of the strands extend along the full length of the substrate portion. This prevents the strands from dislodging easily from the substrate section. Alternatively or additionally, strand length may be controlled by the cutting process.

In preferred embodiments, the weight of the aerosol-forming substrate is between 59 milligrams and 190 milligrams, preferably between 70 milligrams and 170 milligrams, more preferably between 115 milligrams and 155 milligrams most preferably around 132 milligrams. This amount of aerosol forming typically allows for sufficient material for the formation of an aerosol. Additionally, in the light of the aforementioned constraints on diameter and size, this allows for a balanced density of the aerosol-forming substrate between energy uptake, resistance to draw and fluid passageways within the substrate section where the substrate comprises plant material.

The aerosol-forming substrate may be soaked with aerosol former. Soaking the aerosol-forming substrate can be done by spraying or by other suitable application methods. The aerosol former may be applied to the blend during preparation of the cut-filler. For example, the aerosol former may be applied to the blend in the direct conditioning casing cylinder (DCCC). Conventional machinery can be used for applying an aerosol former to the cut-filler. The aerosol former may be any suitable known compound or mixture of compounds that, in use, facilitates formation of a dense and stable aerosol. The aerosol former may be facilitating that the aerosol is substantially resistant to thermal degradation at temperatures typically applied during use of the aerosol-generating article. Suitable aerosol formers are for example to: polyhydric alcohols such as, for example, triethylene glycol, 1,3-butanediol, propylene glycol and glycerine; esters of polyhydric alcohols such as, for example, glycerol mono-, di- or triacetate; aliphatic esters of mono-, di- or polycarboxylic acids such as, for example, dimethyl dodecanedioate and dimethyl tetradecanedioate; and combinations thereof.

Preferably, the aerosol former comprises one or more of glycerine and propylene glycol. The aerosol former may consist of glycerine or propylene glycol or of a combination of glycerine and propylene glycol.

Preferably, the amount of aerosol former is between 6 percent and 20 percent by weight on a dry weight basis of the aerosol-forming substrate, more preferably, the amount of aerosol former is between 8 percent and 18 percent by weight on a dry weight basis of the aerosol-forming substrate, most preferably the amount of aerosol former is between 10 percent and 15 percent by weight on a dry weight basis of the aerosol-forming substrate. For some embodiments the amount of aerosol former has a target value of about 13 percent by weight on a dry weight basis of the aerosol-forming substrate. The most efficient amount of aerosol former will depend also on the aerosol-forming substrate, whether the aerosol-forming substrate comprises plant lamina or homogenized plant material. For example, among other factors, the type of substrate will determine to which extent the aerosol-former can facilitate the release of substances from the aerosol-forming substrate.

For these reasons, the aerosol-forming substrate of the present invention may be capable of efficiently generating sufficient amount of aerosol at relatively low temperatures. A temperature of between 150 degrees Celsius and 220 degrees Celsius in the heating chamber may be sufficient for the aerosol-forming substrate to generate sufficient amounts of aerosol.

Alternatively or additionally, the aerosol-generating substrate may be impregnated with aerosol former. Providing homogenised tobacco material may improve aerosol generation, the nicotine content and the flavour profile of the aerosol generated during heating of the aerosol-generating article. Specifically, the process of making homogenised tobacco may involve grinding one or more of botanicals, tobacco leaf tobacco root, tobacco flower and tobacco seeds, which more effectively enables the release of nicotine and flavours upon heating.

The homogenised tobacco material is preferably provided in sheets which are one of folded, crimped, or cut into strips. In a particularly preferred embodiment, the sheets are cut into strips having a width of between about 0.2 millimetres and about 2 millimetres, more preferably between about 0.4 millimetres and about 1.2 millimetres. In one embodiment, the width of the strips is about 0.9 millimetres.

Alternatively, the homogenised tobacco material may be formed into spheres using spheronisation. The mean diameter of the spheres is preferably between about 0.5 millimetres and about 4 millimetres, more preferably between about 0.8 millimetres and about 3 millimetres.

The aerosol-generating substrate preferably comprises: homogenised tobacco material between about 55 percent and about 75 percent by weight; aerosol-former between about 15 percent and about 25 percent by weight; and water between about 10 percent and about 20 percent by weight.

Before measuring the samples of aerosol-generating substrate they are equilibrated for 48 hours at 50 percent relative humidity at 22 degrees Celsius. The Karl Fischer technique is used to determine the water content of the homogenised tobacco material.

The aerosol-generating substrate may further comprise a flavourant between about 0.1 percent and about 10 percent by weight. The flavourant may be any suitable flavourant known in the art, such as menthol.

Sheets of homogenised tobacco material for use in aerosol-generating articles comprising a capsule may be formed by agglomerating particulate tobacco obtained by grinding or otherwise comminuting one or both of tobacco leaf lamina and tobacco leaf stems.

Sheets of homogenised tobacco material for use in aerosol-generating articles comprising a capsule may comprise one or more intrinsic binders that is a tobacco endogenous binder, one or more extrinsic binders that is a tobacco exogenous binder, or a combination thereof to help agglomerate the particulate tobacco. Alternatively, or in addition, sheets of homogenised tobacco material may comprise other additives including, but not limited to, tobacco and non-tobacco fibres, flavourants, fillers, aqueous and non-aqueous solvents and combinations thereof.

Suitable extrinsic binders for inclusion in sheets of homogenised tobacco material for use in aerosol-generating articles comprising a capsule are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and 30 pectins; and combinations thereof.

A number of reconstitution processes for producing sheets of homogenised tobacco materials are known in the art. These include, but are not limited to: paper-making processes of the type described in, for example, U.S. Pat. No. 3,860,012; casting or 'cast leaf' processes of the type described in, for example, U.S. Pat. No. 5,724,998; dough reconstitution processes of the type described in, for example, U.S. Pat. No. 3,894,544; and extrusion processes of the type described in, for example, in GB-A-983,928. Typically, the densities of sheets of homogenised tobacco material produced by extrusion processes and dough reconstitution processes are greater than the densities of sheets of homogenised tobacco materials produced by casting processes.

Sheets of homogenised tobacco material for use in aerosol-generating articles comprising a capsule are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The homogenised tobacco sheet material may be produced using different types of tobacco. For example, tobacco sheet material may be formed using tobaccos from a number of different varieties of tobacco, or tobacco from different regions of the tobacco plant, such as leaves or stem. After processing, the sheet has consistent properties and a homogenised flavour. A single sheet of homogenised tobacco material may be produced to have a specific flavour. To produce a product having a different flavour, a different tobacco sheet material needs to be produced. Some flavours that are produced by blending a large number of different shredded tobaccos in a conventional cigarette may be difficult to replicate in a single homogenised tobacco sheet. For example, Virginia tobaccos and Burley tobaccos may need to be processed in different ways to optimise their individual flavours. It may not be possible to replicate a particular blend of Virginia and Burley tobaccos in a single sheet of homogenised tobacco material. As such, the aerosol-generating substrate may comprise a first homogenised tobacco material and a second homogenised tobacco material. By combining two different sheets of tobacco material in a single aerosol-generating substrate, new blends may be created that could not be produced by a single sheet of homogenised tobacco.

The aerosol-former preferably comprises at least one polyhydric alcohol. In a preferred embodiment, the aerosol-former comprises at least one of: triethylene glycol; 1,3-butanediol; propylene glycol; and glycerine.

The invention further relates to an aerosol-generating system comprising an aerosol-generating device as described herein and an aerosol-generating article as described herein.

The first sealing wrapper of the aerosol-generating article may be arranged to align with the first sealing element of the aerosol-generating device, when the aerosol-generating article may be received in the cavity of the aerosol-generating device. The first sealing wrapper of the aerosol-generating article may be arranged to contact the first sealing element of the aerosol-generating device, when the aerosol-generating article is received in the cavity of the aerosol-generating device. The contact between the first sealing wrapper and the first sealing element may be a sealing contact.

The first sealing wrapper of the aerosol-generating article may be arranged to align with the second sealing element of the aerosol-generating device, when the aerosol-generating article is fully received in the cavity of the aerosol-generating device. The first sealing wrapper of the aerosol-generating article is preferably arranged to contact the first sealing element of the aerosol-generating device when the aerosol-generating article is fully received in the cavity of the aerosol-generating device.

The second sealing wrapper of the aerosol-generating article may be arranged to align with the second sealing element of the aerosol-generating device, when the aerosol-generating article may be received in the cavity of the aerosol-generating device. The second sealing wrapper of the aerosol-generating article may be arranged to contact the second sealing element of the aerosol-generating device, when the aerosol-generating article is received in the cavity of the aerosol-generating device. The contact between the second sealing wrapper and the second sealing element may be a sealing contact.

The first sealing wrapper of the aerosol-generating article may be arranged to align with the second sealing element of the aerosol-generating device, when the aerosol-generating article is fully received in the cavity of the aerosol-generating device. The second sealing wrapper of the aerosol-generating article is preferably arranged to contact the second sealing element of the aerosol-generating device when the aerosol-generating article is fully received in the cavity of the aerosol-generating device.

Features described in relation to one aspect may equally be applied to other aspects of the invention.

The invention will be further described, by way of example only, with reference to the accompanying drawings in which.

Figure 1A:
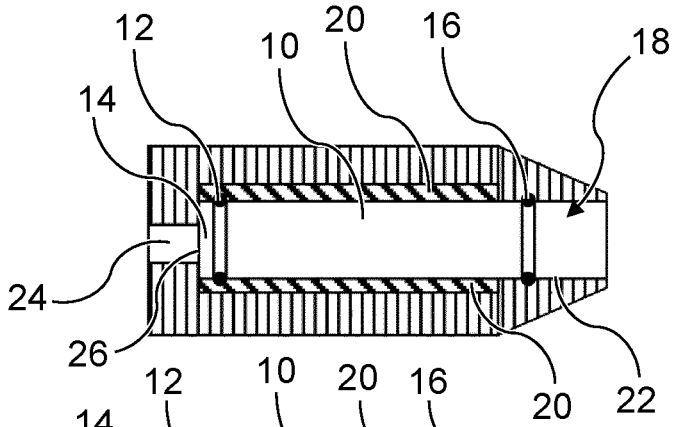
FIGS. 1A to 1C show a cross-sectional view of different embodiments of the aerosol-generating device according to the invention.
Figure 2:
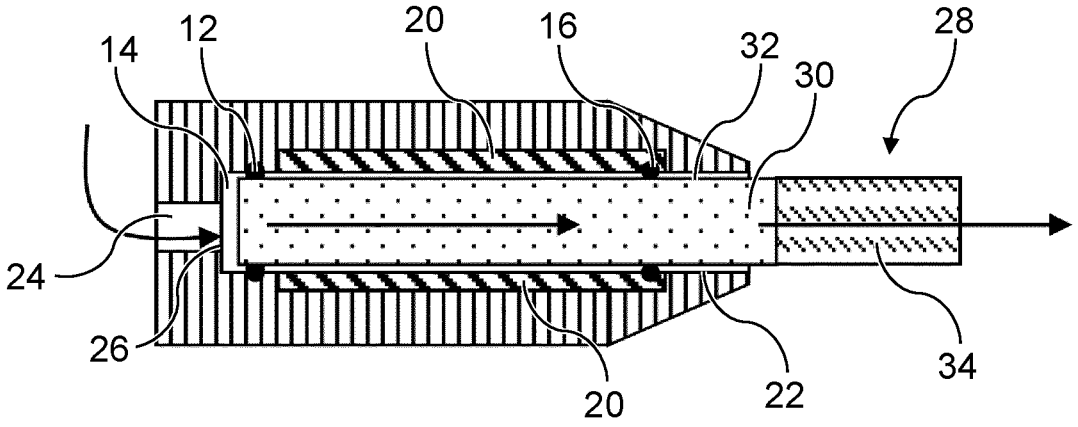
FIG. 2 shows an embodiment of an aerosol-generating device with an inserted aerosol-generating article.

In FIG. 1A, an aerosol-generating device is depicted. The aerosol-generating device comprises a cavity 10. The cavity 10 is configured for receiving an aerosol-generating article 28 (the aerosol-generating article 28 is depicted in FIGS. 2, 3 and 4). The cavity 10 comprises a first sealing element 12. The first sealing element 12 is arranged adjacent an upstream end 14 of the cavity 10. Additionally, a second sealing element 16 is arranged adjacent a downstream end 18 of the cavity 10.

FIG. 1A further shows a heating element 20. The heating element 20 is configured as an external heating element 20. The heating element 20 at least partly forms a sidewall 22 of the cavity 10. In other embodiments, the heating element 20 may be configured as an internal heating element 20, in which case the heating element 20 is preferably centrally arranged within the cavity 10 as a heating pin or heating blade. The heating element 20 may be an electrically resistive heating element 20. The heating element 20 may alternatively be an induction heating element 20.

The first sealing element 12 and the second sealing element 16 are arranged along the sidewall 22.

The aerosol-generating device may comprise further elements such as a main body comprising a power supply and a controller for powering the heating element 20. The aerosol-generating device may comprise further elements such as a button for activating the aerosol-generating device and a puff sensor for sensing a puff.

In FIG. 1A, an air inlet 24 is depicted at a base 26 of the aerosol-generating device. The air inlet 24 enables air to enter the cavity 10 at the upstream end 14 of the cavity 10. During operation, air is drawn through the aerosol-generating device by a user. When a user draws on the aerosol-generating article 28 received in the cavity 10, air is drawn into the cavity 10 through the air inlet 24. Subsequently, air is drawn through the aerosol-generating article 28 and towards the mouth of the user. A user may directly draw on the aerosol-generating article 28 or on a mouthpiece of the aerosol-generating device.

In FIG. 1A, the first sealing element 12 is arranged in contact with the heating element 20. The first sealing element 12 preferably comprises or consists of a thermally resistive material so that the first sealing element 12 may be protected from the elevated temperature of the heating element 20. In the embodiment shown in FIG. 1A, the second sealing element 16 is arranged distanced from the heating element 20 downstream of the heating element 20. The second sealing element 16 may potentially comprise or consist of a material that is not as resistant to elevated temperatures as the first sealing element 12. In FIG. 1A, the second sealing element 16 is arranged not in contact with the heating element 20.

Figure 1B:
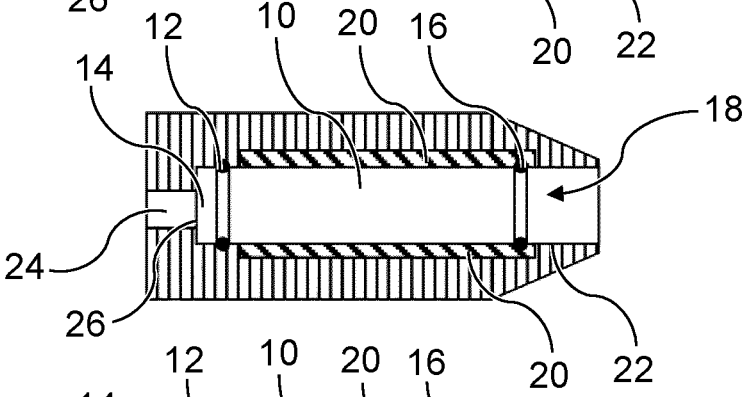
Figure 1C:
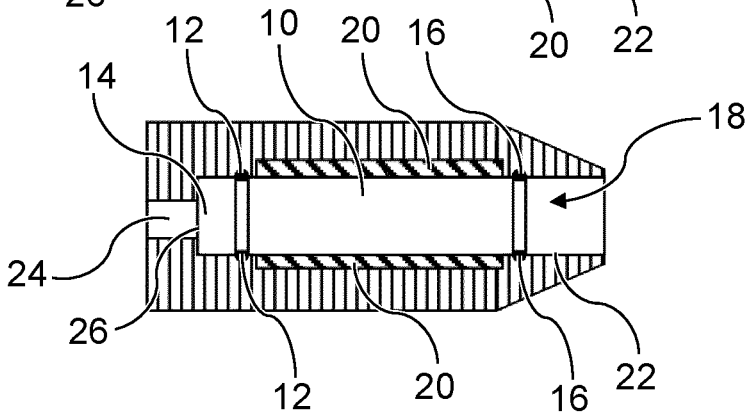

However, different arrangements of the sealing elements are possible as shown in FIGS. 1B and 1C. In FIG. 1B, the first sealing element 12 is arranged distanced from the heating element 20 upstream of the heating element 20 and the second sealing element 16 is arranged in contact with the heating element 20. In FIG. 1C, the first sealing element 12 as well as the second sealing element 16 are arranged distanced from the heating element 20. In this embodiment, the first sealing element 12 is arranged upstream of the heating element 20 and the second sealing element 16 is arranged downstream of the heating element 20. It is also conceivable that both of the sealing elements 12, 16 are in contact with the heating element 20.

One or both of the first sealing element 12 and the second sealing element 16 are preferably O-rings. One or both of the first sealing element 12 and the second sealing element 16 may be arranged in corresponding grooves in the sidewall 22 of the cavity 10 to prevent axial movement of the sealing elements during insertion and removal of the aerosol-generating article 28. The outer diameter of one or both of the first sealing element 12 and the second sealing element 16 may correspond to or may be slightly larger than the inner diameter of the cavity 10. The inner diameter of one or both of the first sealing element 12 and the second sealing element 16 may correspond to or may be slightly smaller the outer diameter of the aerosol-generating article 28.

When the aerosol-generating article 28 is inserted into the cavity 10, airflow between the sidewall 22 of the cavity 10 and the aerosol-generating article 28 is substantially prevented by the first and second sealing elements 12, 16. In this regard, the first sealing element 12 arranged at the upstream region of the sidewall 22 of the cavity 10 prevents that the air enters in the gap between the aerosol-generating article 28 and the sidewall 22 of the cavity 10, when the aerosol-generating article 28 is received in the cavity 10.

Consequently, the air initially enters into the aerosol-generating article 28 after the air enters into the cavity 10 through the air inlet 24. The air subsequently travels in a downstream direction as indicated by the arrow in FIG. 2 through the aerosol-generating article 28. The second sealing element 16 arranged at a downstream region of the sidewall 22 of the cavity 10 prevents that the air exits the aerosol-generating article 28 into the gap between the sidewall 22 of the cavity 10 at the aerosol-generating article 28 downstream of the first sealing element 12. As a consequence, airflow is forced through a substrate portion 30 of the aerosol-generating article 28.

To further facilitate that the airflow through the aerosol-generating article 28, a wrapping paper 32 of the aerosol-generating article 28 surrounding the aerosol-generating article 28 may be configured air impermeable.

Figure 3A:
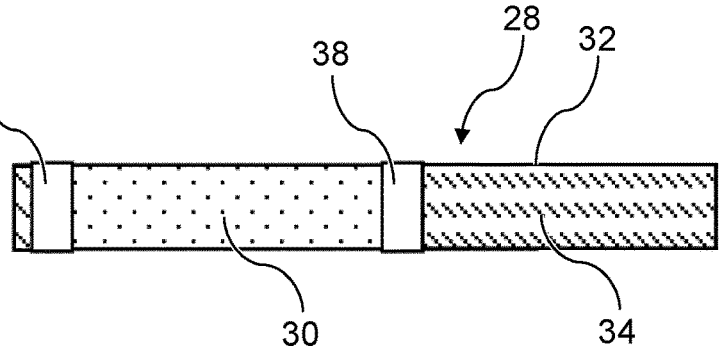
FIG. 3A shows an aerosol-generating article with sealing wrappers.

FIG. 3A shows an embodiment of the aerosol-generating article 28, in which the aerosol-generating article 28 comprises a first sealing wrapper 36 and a second sealing wrapper 38. The first sealing wrapper 36 and the second sealing wrapper 38 are provided in addition to the wrapping paper 32 of the aerosol-generating article 28. The wrapping paper 32 may be provided to connect the substrate portion 30 of the aerosol-generating article 28 with a filter portion 34 of the aerosol-generating article 28. The first sealing wrapper 36 of the aerosol-generating article 28 is configured to sealingly engage the first sealing element 12 of the aerosol-generating device, when the aerosol-generating article 28 is received in the cavity 10 of the aerosol-generating device. The second sealing wrapper 38 of the aerosol-generating article 28 is configured to sealingly engage the second sealing element 16 of the aerosol-generating device, when the aerosol-generating article 28 is received in the cavity 10 of the aerosol-generating device.

Figure 3B:
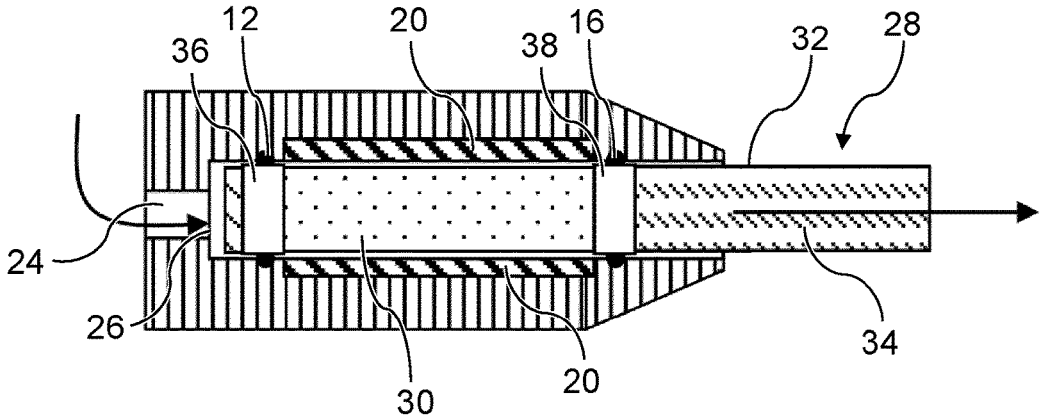
FIG. 3B shows the insertion of the aerosol-generating article into the aerosol-generating device and airflow direction.

One or both of the first sealing wrapper 36 and the second sealing wrapper 38 preferably fully surround the outer circumference of the aerosol-generating article 28. One or both of the first sealing wrapper 36 and the second sealing wrapper 38 preferably increase the outer diameter of the aerosol-generating article 28. A consequence of the increased outer diameter of the aerosol-generating article 28 is that the aerosol-generating article 28 is securely held in the cavity 10 of the aerosol-generating device after insertion of the aerosol-generating article 28 into the cavity 10. Particularly, the sealing engagement between the first sealing wrapper 36 and the first sealing element 12 and between the second sealing wrapper 38 and the second sealing element 16 is facilitated by the increased diameter of the aerosol-generating article 28 in the area of the first sealing wrapper 36 and in the area of the second sealing wrapper 38. As depicted in FIG. 3B, after insertion of the aerosol-generating article 28 into the cavity 10 of the aerosol-generating device, the first sealing wrapper 36 of the aerosol-generating article 28 abuts the first sealing element 12 of the aerosol-generating device and the second sealing wrapper 38 of the aerosol-generating article 28 abuts the second sealing element 16 of the aerosol-generating device. As a consequence, airflow is prevented between the sidewall 22 of the cavity 10 and the aerosol-generating article 28 and airflow is forced through the aerosol-generating article 28.

Figure 4A:
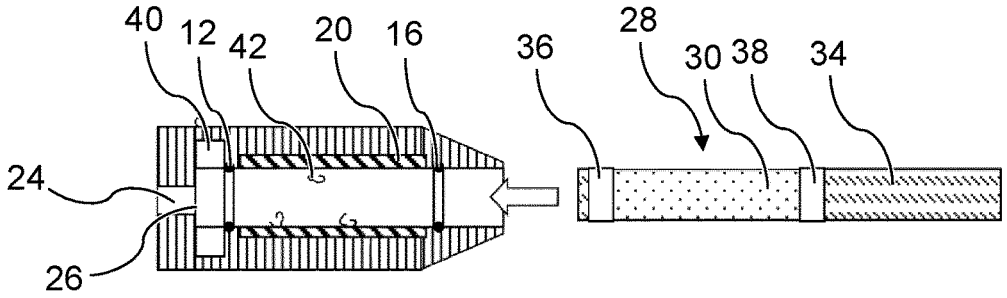
FIG. 4A shows an aerosol-generating device and an aerosol-generating article not inserted in the device.

FIG. 4A shows an embodiment, in which a recess 40 is provided adjacent the upstream end 14 of the cavity 10 of the aerosol-generating device. The recess 40 may fully surround the cavity 10. The recess 40 may extend in a direction perpendicular to the longitudinal axis of the cavity 10. The recess 40 may extend in a direction perpendicular to the longitudinal axis of the aerosol-generating device. As can be seen in FIG. 4A, unwanted residues 42 may remain in the cavity 10 after the aerosol-generating article 28 is depleted and removed from the cavity 10 of the aerosol-generating device.

Figure 4B:
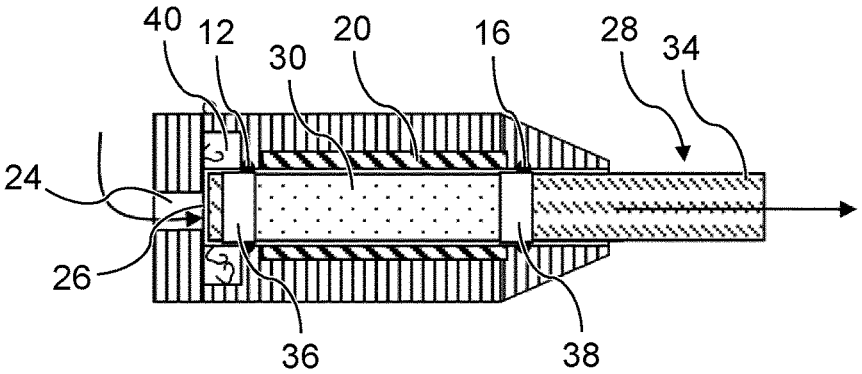
FIG. 4B shows the aerosol-generating device of FIG. 4A with inserted aerosol-generating article.

As shown in FIG. 4B, during insertion of a fresh aerosol-generating article 28 into the cavity 10 of the aerosol-generating device, the unwanted residues 42 are scraped off of the sidewall 22 of the cavity 10 of the aerosol-generating device by the fresh aerosol-generating article 28. Particularly, the first sealing wrapper 36 of the aerosol-generating article 28 may have a sufficient stiffness to enable a scraping action of unwanted residues 42 from the sidewall 22 of the aerosol-generating device. The first sealing wrapper 36 may be stiff. After the aerosol-generating article 28 has been inserted into the cavity 10 of the aerosol-generating device, the unwanted residues 42 that have been scraped off of the sidewall 22 of the cavity 10 of the aerosol-generating article 28 can be pushed into the recess 40 at the base 26 of the cavity 10. As a consequence, the unwanted residues 42 do not accumulate at the base 26 of the aerosol-generating device or along the sidewalls of the cavity 10 and do not negatively impair airflow into the cavity 10 through the air inlet 24.

Figure 5:
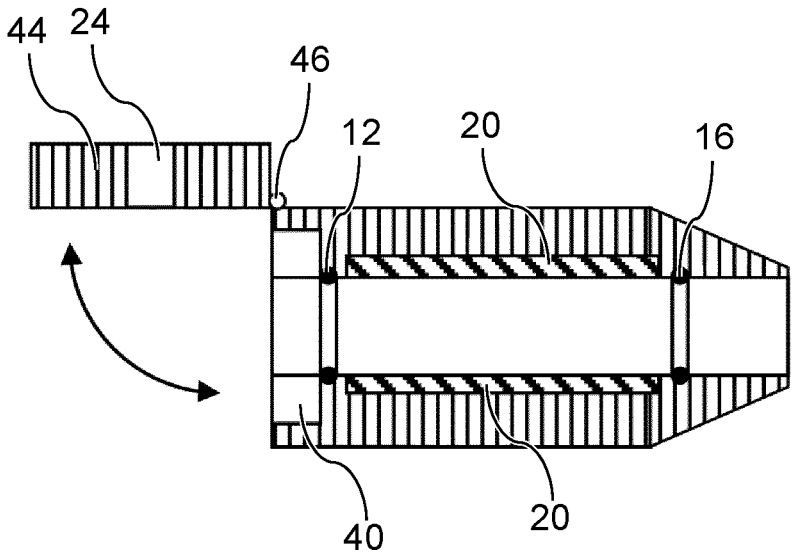
FIG. 5 shows an aerosol-generating device and an aerosol-generating article received in the aerosol-generating device, the aerosol-generating device having a bottom element attached to the base of the cavity.

FIG. 5 shows an embodiment, in which a bottom element 44 is arranged adjacent the base 26 of the cavity 10. In the embodiment depicted in FIG. 5, the bottom element 44 is pivotably attached to the aerosol-generating device. The bottom element 44 may be attached to the aerosol-generating device by means of a hinge 46. The bottom element 44 can be opened to enable access to the base 26 of the cavity 10 of the aerosol-generating device. Particularly, opening of the bottom element 44 enables access to the recess 40 so as to clean unwanted residues 42 from the recess 40. Instead of configuring the bottom element 44 pivotably attached to the aerosol-generating device, in other embodiments, the bottom element 44 may be configured slidably attached to the aerosol-generating device. If the bottom element 44 is slidably attached to the aerosol-generating device, the bottom element 44 is preferably configured to slide in a direction perpendicular to the longitudinal axis of the aerosol-generating device to enable opening of the cavity 10 at the upstream end 14 of the cavity 10. For example, the bottom element may be a drawn, slidable along rails of the device. The bottom element 44 may enable closing of the cavity 10 at the upstream end 14 of the cavity 10. A user may open the bottom element 44 after usage to remove any unwanted residues 42 from the cavity 10 and subsequently close the bottom element 44.

The invention claimed is:

1. An aerosol-generating device comprising:

a cavity configured to receive an aerosol-generating article;

a first sealing element arranged along a sidewall of the cavity, wherein the first sealing element is arranged at an upstream portion of the cavity;

a second sealing element, wherein the second sealing element is arranged at a downstream portion of the cavity;

a power supply; and an induction heating element, wherein the induction heating element is an external heating element surrounding the cavity.

2. The aerosol-generating device according to claim 1, wherein the first sealing element is arranged such that an airflow between the sidewall of the cavity and the received aerosol-generating article is prevented in the region of the first sealing element.

3. The aerosol-generating device according to claim 1, wherein one or both of each of the first and second sealing elements are each arranged to provide a circumferential seal between the sidewall of the cavity and an aerosol-generating article when the aerosol-generating article is received in the cavity.

4. The aerosol-generating device according to claim 1, wherein one or both of the first and second sealing elements are configured as O-rings.

5. The aerosol-generating device according to claim 1, wherein one or both of the sealing elements comprise thermo-resistant material.

6. The aerosol-generating device according to claim 1, wherein the device comprises a recess in the sidewall of the cavity adjacent a base of the cavity.

7. The aerosol-generating device according to claim 1, wherein the device comprises a movable bottom element arranged adjacent the base of the cavity.

8. An aerosol-generating system comprising an aerosol-generating device according to claim 1 and an aerosol-generating article.

9. The aerosol-generating system according to claim 8, wherein the aerosol-generating article comprising:

a wrapping paper around the outer circumference of the aerosol-generating article;

a first sealing wrapper, wherein the first sealing wrapper partly covers the wrapping paper and increases the diameter of the aerosol-generating article in the region of the first sealing wrapper, and a second sealing wrapper, wherein the first sealing wrapper is arranged at an upstream portion of the aerosol-generating article and the second sealing wrapper is arranged at a downstream portion of the aerosol-generating article.

10. The aerosol-generating system according to claim 9, wherein the first sealing wrapper of the aerosol-generating article is arranged to contact the first sealing element of the aerosol-generating device, when the aerosol-generating article is received in the cavity of the aerosol-generating device.

11. The aerosol-generating system according to claim 9, wherein the second sealing wrapper of the aerosol-generating article is arranged to contact the second sealing element of the aerosol-generating device, when the aerosol-generating article is received in the cavity of the aerosol-generating device.

* * * * *